United States Patent [19]

Häberle et al.

[11] Patent Number: 4,574,532

[45] Date of Patent: Mar. 11, 1986

[54] PROTECTIVE-HOOD FASTENING FOR PORTABLE ANGLED GRINDERS

[75] Inventors: Egon Häberle, Stuttgart; Bernd Schwarz, Esslingen, both of Fed. Rep. of Germany

[73] Assignee: C. & E. Fein GmbH & Co., Stuttgart, Fed. Rep. of Germany

[21] Appl. No.: 660,898

[22] Filed: Oct. 15, 1984

[30] Foreign Application Priority Data

Oct. 27, 1983 [DE] Fed. Rep. of Germany ..... 3338917

[51] Int. Cl.[4] ..... B24B 55/04

[52] U.S. Cl. ..... 51/268; 144/251 A

[58] Field of Search ..... 51/268, 170 PT, 273, 51/262 R, 170 T, 170 R; 144/251 R, 251 A

[56] References Cited

FOREIGN PATENT DOCUMENTS 3135820 3/1983 Fed. Rep. of Germany ..... 51/268

940226 10/1963 United Kingdom ..... 51/268

*Primary Examiner*—Roscoe V. Parker

*Attorney, Agent, or Firm*—Max Fogiel

[57] ABSTRACT

A protective-hood fastening for portable angled grinders is disclosed. The protective hood is attached by a tensioning strap and screw to, and can be released from, a spindle collar on the gear housing. A securing element prevents the hood from slipping off the housing and into the grinding disk.

11 Claims, 6 Drawing Figures

PROTECTIVE-HOOD FASTENING FOR PORTABLE ANGLED GRINDERS

BACKGROUND OF THE INVENTION

The present invention relates to a protective-hood fastening for portable angled grinders in which the protective hood is attached by means of a tensioning strap and screw to, and can be released from, a spindle collar on the gear housing in such a way that the inner surface of the strap rests against the outer surface of the collar.

Fastenings of this type are known. The protective hood covers the area of the grinding disk that is not employed on the workpiece.

In working with portable angled grinders it is not unusual for the tensioning strap to work loose from the spindle collar, allowing the protective hood to slip off the gear housing toward the grinding disk. This unintended malfunction can mainly be ascribed to the screw that secures the tensioning strap getting loose or to contaminants that accumulated between the strap and the collar. One consequence is that the rotating disk damages the hood.

The malfunction has been dealt with up to the present time by machining a groove around the spindle collar that is engaged radially outward from the tensioning strap by an additional screw. The drawback to this solution is that the additional screw has to be loosened in order to rotate the hood.

Another design also involves a groove around the spindle collar, but engaged by a matching bead on the inner surface of the strap. This essentially aggravates mounting the hood because it is very difficult to slip the strap over the collar.

SUMMARY OF THE INVENTION

The object of the present invention is to provide a protective-hood fastening for a portable angled grinder wherein the tensioning strap will not work loose from the spindle collar.

This object is attained in accordance with the invention with a securing element at the face of the spindle collar that extends over the outside diameter of the collar and the inside diameter of the strap.

In order to slip the tensioning strap over the collar, the gap between the flanges on the strap must first be positioned over the securing element. The strap can then be slipped over the collar and turned.

Different types of securing element can be employed. In one, the simplest, embodiment the securing element is a flat disk that is fastened to the face of the spindle collar with a screw.

In another embodiment the securing element is a spring-loaded element that pivots on the face of the spindle collar. It can accordingly move radially subject to the force of the spring. In one variant of this embodiment the securing element is provided with a trough to facilitate handling. In another variant the securing element has a beveled or rounded surface on the side facing away from the face of the spindle collar to facilitate insertion. In a third variant a tensioning strap on the protective hood has a beveled or rounded surface on the side facing the spindle collar to facilitate insertion.

In a third embodiment the securing element is a snap-in lever that pivots on the face of the spindle collar. In this embodiment the securing element is attached with a screw in a way similar to that employed in the first embodiment. It is, however, not screwed rigidly to the collar but can pivot around the screw. Thus, the protective hood can be retained in a specific position or released by simply pivoting the securing element. In one variant of this embodiment the securing element has a grasping bead to facilitate handling. In another variant a depression is machined into the face of the spindle collar.

In the last two embodiments the gap between the flanges on the tensioning strap does not have to be aligned with the securing element when the strap is slipped over the spindle collar. In the second embodiment the securing element will yield when the tensioning strap is slipped over the collar and, once the strap is in place, will return to its starting position.

The embodiments described herein ensure simple assembly and facilitate rotating the protective hood into the desired operating position while simultaneously securing it against coming loose axially.

Some preferred embodiments of the invention will now be described with reference to the attached drawings, wherein

DETAILED DESCRIPTION OF THE PREFERRED EMBODIMENTS

Figure 1:
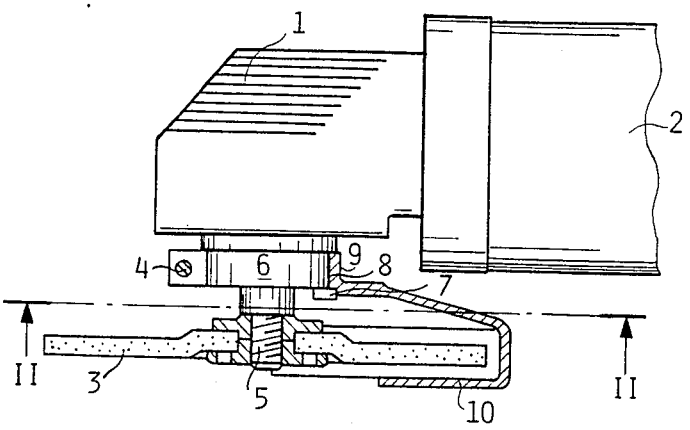
FIG. 1 is a side view of a portable angle grinder with the protective hood represented in section.

FIG. 1 illustrates a portable angled grinder that consists essentially of a gear housing 1 and of a motor housing 2. The rotation of the motor is transmitted inside gear housing 1 to a spindle 5 through an angular gear. A grinding disk 3 is fastened to working spindle 5.

Figure 2:
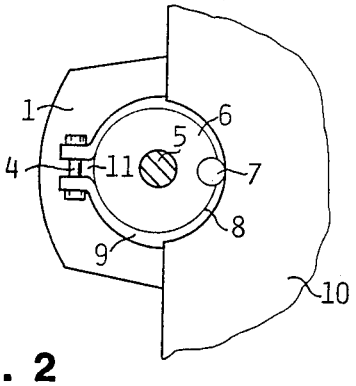
FIG. 2 is a section along line II—II in FIG. 1.
Figure 3:
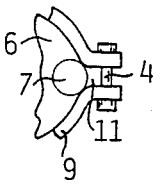
FIG. 3 is a section similar to that in FIG. 2 but with the protective hood inserted.

Spindle 5 is mounted in a spindle collar 6 that projects out of gear housing 1. A securing element 7 extends at the face of spindle collar 6 beyond the surface 8 of collar 6. A protective hood 10 is attached before the grinding disk 3 is mounted. The hood is slipped over spindle collar 6 in a particular position illustrated in FIG. 3. In this position the gap 11 between the flanges on tensioning strap 9 will pass by securing element 7. From the rear position, which is the catch position, protective hood 10 can be rotated into any desired operating position and secured there by tightening tensioning strap 9 with a screw 4. It is practical not to position flange gap 11 where, in a frequently occurring operating position of protective hood 10, the gap will coincide with securing element 7. FIG. 2 illustrates a practical state.

Figure 4:
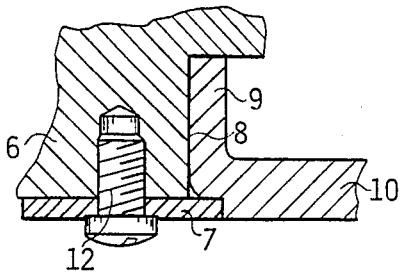
FIG. 4 is an enlarged detail of FIG. 1 in section.

FIG. 4 illustrates an embodiment in which securing element 7 projects beyond the outside diameter of spindle collar 6. In this position it is impossible for protective hood 10 to slip off spindle collar 6. The hood cannot be removed from the collar until the hood has been rotated into the position in which securing element 7 can engage flange gap 11. The securing element 7 in the illustrated embodiment is attached with a screw 12. Other types of attachment like rivets or welding are of course also possible. The securing element can also be in one piece with the spindle collar 6 or screw 12 can have a head that is large enough to project as far beyond the outer diameter of spindle collar 6 as securing element 7.

Figure 5:
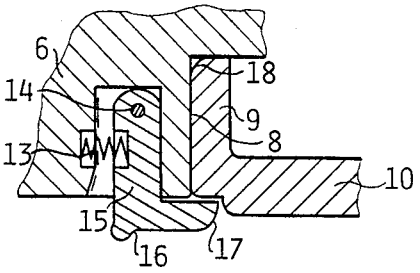
FIG. 5 is a variant of FIG. 4.

FIG. 5 shows how protective hood 10 can be secured with a spring-loaded securing element 15 instead of one attached with a screw. As the tensioning strap 9 on protective hood 10 is slipped over the surface 8 of collar 6, securing element 15, which can pivot on pivot 14 against the force of a spring 13, yields backwards and does not return to its original position, the securing position, until protective hood 10 has moved past the face of spindle collar 6. Although this embodiment is somewhat more expensive than that illustrated in FIGS. 1 through 4, no attention has to be paid to the position of the gap 11 between the flanges on a tensioning strap 9 because securing element 15 can project far enough beyond the outside diameter of spindle collar 6. The surfaces 17 and 18 on securing element 15 and tensioning strap 9 can be beveled or rounded in a practical way to facilitate insertion.

A shallow depression or trough 16 can be provided in a practical way on the side of securing element 15 that faces away from the face of spindle collar 6 to facilitate manipulating the element by hand.

Figure 6:
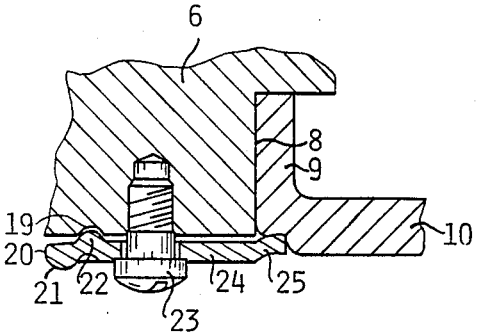
FIG. 6 is another variant of FIG. 4.

FIG. 6 illustrates an embodiment in which a securing element 24 pivots around a screw 23 on the face of spindle collar 6. Pivoting securing element 24 around screw 23 will position either the shorter end 20 or the longer end 25 of the element toward protective hood 10. In the first case, shorter end 20 will not extend beyond the surface 8 of collar 6 and tensioning flange 9 will be able to move axially without impediment. In the second case, the movement of tensioning flange 9 will be axially impeded by the longer end 25 of securing element 24. The position of securing element 24 can be fixed with a depression 19 in spindle collar 6 that a matching elevation 22 on securing element 24 can snap into. Securing element 24 has a bead 21 on its shorter end 20 to facilitate manipulation.

The present specification and claims are of course intended solely as illustrative of one or more potential embodiments of the invention and should not be construed as limiting it in any way. The invention may accordingly be adapted and modified in many ways without deviating from the theory behind it or exceeding its scope of application.

We claim:

1. Protective-hood fastening arrangement for portable angled grinders comprising: a protective hood; a gear housing and a spindle collar on said gear housing; tensioning strap means and screw means for attaching said protective hood to said spindle collar; said protective hood being releasable from said spindle collar; securing means, said strap means having an inner surface resting against an outer surface of said collar with said securing means at a face of the spindle collar, said securing means extending over the outside diameter of said collar and inside diameter of said strap means; said securing means comprising a snap-in lever pivoting on the face of the spindle collar.

2. Fastening arrangement as defined in claim 1, wherein said securing means has a grasping bead to facilitate handling.

3. Fastening arrangement as defined in claim 2, wherein said spindle collar has a depression machined into the face of said spindle collar.

4. Fastening arrangement as defined in claim 1, wherein said spindle collar has a depression machined into the face of said spindle collar.

5. Protective-hood fastening arrangement for portable angled grinders comprising: a protective hood; a gear housing and a spindle collar on said gear housing; tensioning strap means and screw means for attaching said protective hood to said spindle collar; said protective hood being releasable from said spindle collar; securing means, said strap means having an inner surface resting against an outer surface of said collar with said securing means at a face of the spindle collar, said securing means extending over the outside diameter of said collar and inside diameter of said strap means; said securing means comprising a spring-loaded element pivoting on said spindle collar.

6. Fastening arrangement as defined in claim 5, wherein said securing means has a trough.

7. Fastening arrangement as defined in claim 6, wherein said securing means has a beveled or rounded surface on a side facing away from the face of the spindle collar.

8. Fastening arrangement as defined in claim 6, wherein a tensioning strap on said protective hood has a beveled or rounded surface on a side facing said spindle collar.

9. Fastening arrangement as defined in claim 5, wherein said securing means has a beveled or rounded surface on a side facing away from the face of the spindle collar.

10. Fastening arrangement as defined in claim 9, wherein a tensioning strap on said protective hood has a beveled or rounded surface on a side facing said spindle collar.

11. Fastening arrangement as defined in claim 5, wherein a tensioning strap on said protective hood has a beveled or rounded surface on a side facing said spindle collar.

* * * * *